United States Patent [19]

Ciccarelli et al.

[11] 4,397,935

[45] Aug. 9, 1983

[54] POSITIVELY CHARGED DEVELOPER COMPOSITIONS CONTAINING QUATERNIZED VINYL PYRIDINE POLYMERS

[75] Inventors: Roger N. Ciccarelli, Rochester; Thomas R. Hoffend, Webster, both of N.Y.

[73] Assignee: Xerox Corporation, Stamford, Conn.

[21] Appl. No.: 342,031

[22] Filed: Jan. 18, 1982

[51] Int. Cl.[3] ..... G03G 9/08

[52] U.S. Cl. ..... 430/110; 430/904

[58] Field of Search ..... 430/110, 904

[56] References Cited

U.S. PATENT DOCUMENTS

| | | | |
|---|---|---|---|
| 3,893,935 | 7/1975 | Jadwin et al. | 252/62.1 |
| 3,944,493 | 3/1976 | Jadwin et al. | 252/62.1 P |
| 3,985,664 | 10/1976 | Sakaguchi et al. | 252/62.1 R |
| 4,079,014 | 3/1978 | Burness et al. | 252/62.1 P |
| 4,221,856 | 9/1980 | Lu | 430/110 |
| 4,298,672 | 11/1981 | Lu | 430/108 |
| 4,299,898 | 11/1981 | Williams et al. | 430/106 |

FOREIGN PATENT DOCUMENTS 1536514 12/1978 United Kingdom .

*Primary Examiner*—John D. Welsh
*Attorney, Agent, or Firm*—E. O. Palazzo

[57] ABSTRACT

The present invention is directed to a developer composition comprised of resin particles, pigment particles, carrier particles, and a charge enhancing additive of the following formula

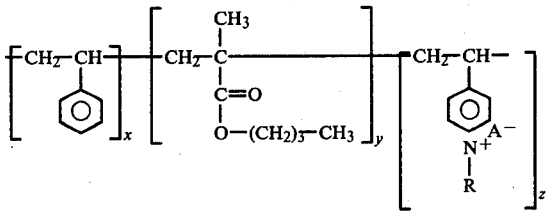

wherein R is an alkyl radical containing from about 1 carbon atom to about 25 carbon atoms, A is an anion, and x, y and z are numbers representing the weight percent of monomer present, wherein z is equal to about 1 weight percent to about 50 weight percent, and the sum of x plus y is equal to 100 minus z, thus this sum is equal to about 50 weight percent to about 99 weight percent, accordingly, the total sum of x+y+z is equal to about 100 weight percent; which compositions are useful in causing the development of electrostatic latent images in electrostatographic imaging systems wherein the photoresponsive device utilized is charged negatively.

16 Claims, No Drawings

POSITIVELY CHARGED DEVELOPER COMPOSITIONS CONTAINING QUATERNIZED VINYL PYRIDINE POLYMERS

BACKGROUND OF THE INVENTION

This invention is generally directed to developer compositions which can be utilized for the development of images in electrostatographic imaging systems. More specifically, the present invention is directed to developer compositions containing certain quaternized vinyl pyridine polymers, as charge enhancing additives. The quaternized vinyl pyridine additives of the present invention impart a positive charge to the toner particles, enabling such particles to be utilized for the development of negatively charged electrostatic latent images.

The electrostatic process, and more specifically, the xerographic process is well known as documented in several prior art references. These processes involve the application of toner particles to the electrostatic latent image, for the purpose of causing development of such images. In some instances it may be desirable to produce a negative copy from a positive original, or a positive copy from a negative original, known as image reversal. In electrostatic imaging systems, image reversal can be accomplished by applying to the image a developer composition, containing toner particles and carrier particles, wherein the toner particles are repelled by the charged areas of the image, but adhere to the discharged areas. More specifically, toner particles possessing positive charges are very useful and effective in electrostatographic reversal systems, especially those employing organic photoreceptors, which in many instances are charged negatively. Reversal developers, which are comprised of electroscopic materials coated with finely divided colloidal silica are described for example, in U.S. Pat. No. 2,986,521.

Several prior art references disclose the use of charge control agents, such as specific quaternary ammonium compound, which agents impart a positive charge to the toner particles. For example, in U.S. Pat. No. 3,893,935, there is disclosed the use of certain quaternary ammonium salts as charge control agents for electrostatic toner compositions. According to the disclosure of this patent, certain quaternary ammonium salts when incorporated into toner materials enabled the provision of a toner composition which exhibited relatively high uniform and stable net toner charge, when mixed with a suitable carrier material. U.S. Pat. No. 4,079,014 contains a similar teaching, with the exception that a different charge control agent is used, namely a diazo type compound.

Many of the above described toners and developers have a tendency over a period of time to lose their positive charge. Also in some instances the charge control additives employed are incompatible with the thermoplastic toner resin, thus causing difficulties in obtaining a uniform dispersion of such additives in the toner resin. Further as some of the prior art charge control agents are not compatible with the toner resin, they adversely affect the electrical properties of the resin. Additionally, primarily because of their low molecular weight, such charge control agents have been known to leach out of the toner composition, and contaminate the carrier surface. Accordingly, thus there is a need for toner and developer compositions which can be used in a reversal system, and more specifically, there is a need for positively charged dry electrostatographic toner materials, which will enable the production of high quality images over extended periods of time.

SUMMARY OF THE INVENTION

It is a feature of this invention to provide a toner composition, and a developer composition, which overcomes the above-noted disadvantages.

It is a further feature of the present invention to provide a developer composition which contains positively charged toner particles, and carrier particles.

Another feature of this invention is the provision of a developer composition which contains positively charged toner particles, and certain charge enhancing additives.

A further feature of the present invention is the provision of certain partially quaternized vinyl pyridinium polymers, and copolymers, as charge enhancing additives.

Another feature of the present invention is to provide developer compositions useful for causing the development of negative electrostatic images, which compositions will transfer effectively, electrostatically to plain bond paper without causing blurring, or otherwise adversely affecting the quality of the resulting image.

These and other features of the present invention are accomplished by providing developer compositions comprised of resin particles, pigment particles, carrier particles, and as a charge enhancing additive, a fully quaternized vinyl pyridinium polymer of the following formula:

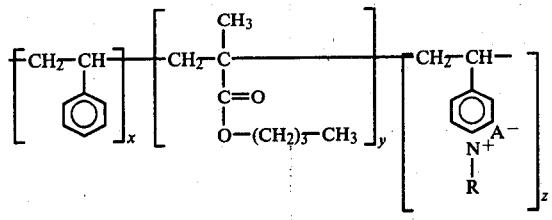

wherein R is an alkyl radical containing from about 1 carbon atom to about 25 carbon atoms, A is an anion, and x, y and z are numbers representing the weight percent of monomer present, wherein z is equal to about 1 weight percent to about 50 weight percent, and the sum of x plus y is equal to 100 minus z, thus this sum is equal to about 50 weight percent to about 99 weight percent. Accordingly, the total sum of x+y+z is equal to about 100 weight percent.

Illustrative examples of alkyl radicals include those containing from about 1 carbon atom to about 25 carbon atoms such as methyl, ethyl, propyl, butyl, pentyl, hexyl, nonyl, decyl, myristyl, cetyl, olelyl, hexadecyl, octadecyl, and the like, with cetyl being the preferred alkyl radical.

The anion A can be various suitable anions illustrative examples of which include halides, such as chloride, bromide or iodide, the following anions,

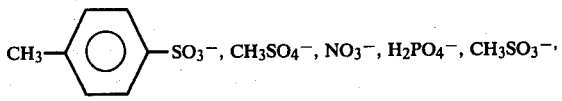

-continued

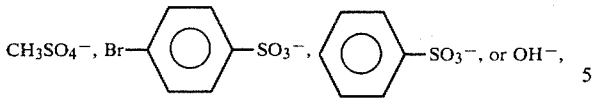

and the like.

Illustrative examples of specific quaternized vinyl pyridine polymers included within the scope of the present invention are represented by the following formulas:

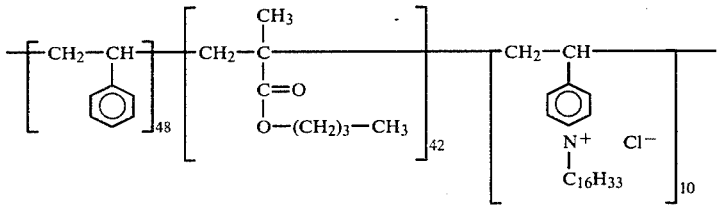

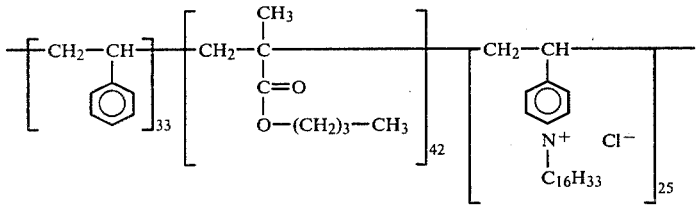

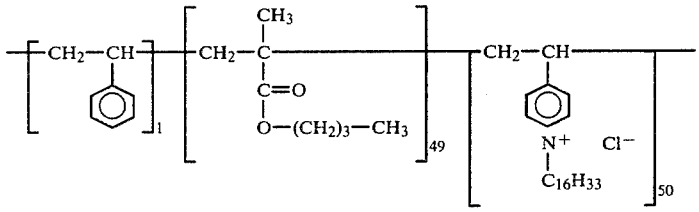

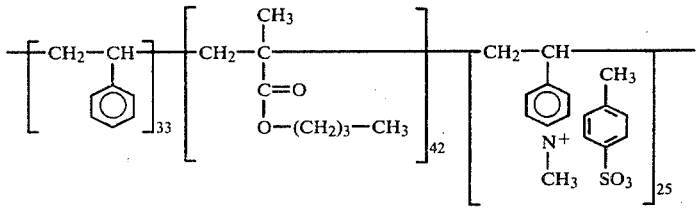

The fully quaternized vinyl pyridine polymers of the present invention are prepared by general processes known in the art thus for example, in one embodiment, these materials can be prepared by obtaining the appropriate polymer which involves reacting together the respective monomers such as styrene alkyl acrylate and a vinyl pyridine, like 4-vinyl pyridine, followed by isolating the resulting polymer. Subsequently, the polymer is dissolved in a suitable solvent, which is also a solvent for the quaternization reaction, such solvents including materials like acetonitrile-toluene mixtures, and the like. A quaternizing agent is then added to the mixture, such as a cetyl halide, and quaternizaton is accomplished at elevated temperatures, and pressures as known in the art. The desired fully quaternized vinyl pyridine polymer is then isolated from the reaction mixture.

Accordingly, there can be obtained a cetyl pyridinium chloride quaternary salt of the following formula by reacting a styrene n-butylmethacrylate vinyl pyridine polymer with cetyl chloride.

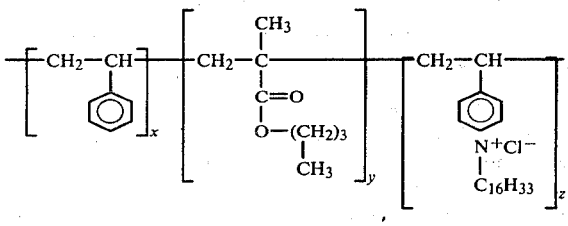

wherein x, y and z are defined hereinbefore.

Similar quaternary salts are provided by employing in place of 4-vinylpyridine, 2-vinylpyridine, 3-vinylpyridne, substituted vinyl pyridines; dimethylaminoethylmethacrylate, t-butylaminoethylmethacrylate, n-ethylaminoethylmethacrylate, and the like. Furthermore, in addition to utilizing cetyl chloride as a reactant, there can be employed other types of halides including cetyl bromide, cetyl fluoride, aromatic halides, such as benzyl chloride, benzyl bromide and the like.

Also for example, there can be prepared the following quaternary ammonium salt by reacting a styrene butylmethacrylate vinylbenzylchloride polymer with an alkyl amine:

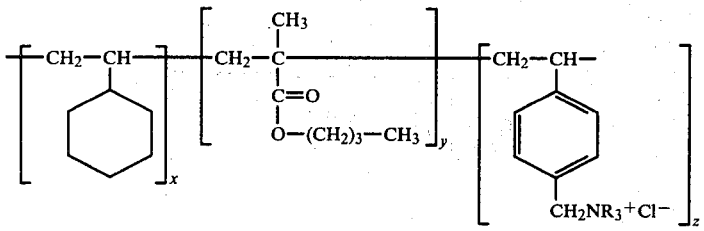

wherein R, x, y and z are defined hereinbefore.

The quaternized salts of the present invention can be used in developing compostions in various amounts, providing they do not adversely effect the composition and result in a toner composition that is charged positively in comparison to the carrier. For example, the amount of charge enhancing additive present varies from about 0.1 weight percent to about 20 weight percent, and preferably such additive is present in an amount of from about 1 weight percent to about 5 weight percent of the total toner weight. The charge enhancing additives can be blended into the developer composition or coated onto the pigment such as carbon black if desired.

While any suitable resin may be employed in the system of the present invention, typical of such resins are polyamides, epoxies, polyurethanes, vinyl resins and polyesters, especially those prepared from dicarboxylic acids and diols. Any suitable vinyl resin may be employed in the toners of the present system, including homopolymers or copolymers of two or more vinyl monomers. Typical of such vinyl monomeric units include: styrene, p-chlorostyrene, vinyl naphthalene, ethylenically unsaturated mono-olefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of aliphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred. The styrene resin employed may be a homopolymer of styrene or styrene homologs of copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired, preferably other vinyl resins, which insure good triboelectric properties and uniform resistance against physical degradation. However, nonvinyl type thermoplastic resins may also be employed including resin modified phenolformaldehyde resins, oil modified epoxy resins, polyurethane resins, cellulosic resins, polyether resins, and mixtures thereof.

Also esterification products of a dicarboxylic acid, and a diol comprising a diphenol may be used as a preferred resin material for the toner composition of the present invention, as illustrated in U.S. Pat. No. 3,655,374, the disclosure of which is totally incorporated herein by reference.

Any suitable pigment or dye may be employed as the colorant for the toner particles, such materials being well known and including for example, carbon black, nigrosine dye, aniline blue, calco oil blue, chrome yellow, ultramarine blue, phthalocyanine blue and mixtures thereof. The pigment or dye should be present in the toner in sufficient quantity to render it highly colored, so that the toner will form a clearly visible image on the recording member. For example, where conventional xerographic copies of documents are desired, the toner may comprise a black pigment, such as carbon black. Preferably, the pigment is employed in amounts of from about 2 percent to about 20 percent by weight, based on the total weight of the toner particles, however, if the colorant employed is a dye, substantially smaller quantities may be used.

Illustrative examples of carrier particles useful in the present invention, include those carrier particles which are capable of triboelectrically obtaining a charge of opposite polarity to that of the toner particles. In the present invention in one embodiment that would be a negative polarity, so that of the toner particles will adhere to and surround the carrier particles. Thus, the carrier particles can be selected so that the toner particles acquire a charge of a positive polarity, and include materials such as sodium chloride, ammonium chloride, ammonium potassium chloride, Rochelle salt, sodium nitrate, aluminum nitrate, potassium chlorate, granular zircon, granular silicon, methylmethacrylate, glass, steel, nickel, iron ferrites, silicon dioxide and the like, with metallic carriers especially magnetic carriers being preferred. The carriers can be used with or without a coating. The coatings generally contain polyvinyl fluoride resins, but other resins especially those which charge negatively, such as polystyrene, halogen containing ethylenes and the like can be used. Many of the typical carriers that can be used are described in U.S. Pat. Nos. 2,618,441; 2,638,522; 3,618,522; 3,591,503; 3,533,835; and 3,526,533. Also nickel berry carriers as described in U.S. Pat. Nos. 3,847,604 and 3,767,598 can be employed, these carriers being nodular carrier beads of nickel characterized by surface of reoccurring recesses and protrusions providing particles with a relatively large external area. The diameter of the coated carrier particle is from about 50 to about 1,000 microns, thus allowing the carrier to possess sufficient density and inertia to avoid adherence to the electrostatic images during the development process.

The carrier may be employed with the toner composition in any suitable combination, however, best results are obtained when about 0.5 parts to about 10 parts of toner, to 100 to 200 parts by weight of carrier, and preferably about 1 part to 5 parts of toner, to 100 parts by weight of carrier.

Developer compositions of the present invention may be used to develop electrostatic latent images on various suitable electrostatic surfaces capable of retaining charge including conventional photoconductors, however, the toners of the present invention are best utilized in systems wherein a negative charge resides on the photoreceptor, and this usually occurs with organic photoreceptors. Examples of such photoreceptors include 4-dimethylaminobenzylidene, benzhydrazide; 2-benzylidene-aminocarbazole, 4-benzylidene-aminocarbazole, polyvinylcarbazole; (2-nitrobenzylidene)-p-bromoaniline; 2,4-diphenyl-quinazoline; 1,2,4-triazine; 1,5-diphenyl3-methyl pyrazoline 2-(4'-dimethyl-amino phenyl)-benzoxazole; 3-aminocarbazole; polyvinylcarbazole-tritrofluorenone charge transfer complex; phthalocyanines, as well as layered organic photoresponsive devices comprised of generating and transport layers. Examples of layered photoresponsive devices include those comprised of a substrate overcoated with a charge generating layer such as triganol selenium or vanadyl phthalocyanine, which in turn is overcoated with a charge transport layer, such as various diamines dispersed in an insulating organic resin, reference U.S. Pat. No. 4,265,990, the disclosure of which is totally incorporated herein by reference. Other overcoated photoresponsive devices include those comprised of a substrate, overcoated with a hole injecting layer, such as carbon black dispersed in a polymer, which is overcoated with a charge transport layer, followed by an overcoating of a charge generating layer, and an overcoating of an insulating organic resin as disclosed in U.S. Pat. No. 4,251,612, the disclosure of which is totally incorporated herein by reference.

Numerous methods may be utilized to produce the toner composition of the present invention, one method involving melt blending the resin and the pigment with the fully quaternized vinyl pyridinium material, followed by mechanical attrition. Other methods include those well known in the art such as spray drying, melt dispersion, and dispersion polymerization. For example, a solvent dispersion of a resin pigment and a fully quaternized vinyl pyridinium polymer and copolymer are spray dryed under controlled conditions, thereby resulting in the desired product. A composition prepared in this manner results in a positively charged toner in relationship to the carrier materials, and these materials exhibit the improved properties as mentioned herein.

In another aspect the present invention is directed to a method of imaging comprising forming a negative electrostatic latent image on an imaging member, contacting the image with a developer composition, comprised of resin particles, pigment particles, carrier particles, and a charge enhancing additive of the following formula:

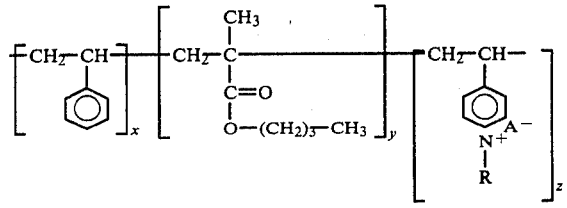

wherein R, A—, x, y and z are as defined hereinbefore.

The following examples are being supplied to further define the species of the present invention, it being noted that these examples are intended to illustrate and not limit the scope of the present invention. Parts and percentage are by weight unless otherwise indicated.

EXAMPLE I

A developer composition was prepared by melt blending, followed by mechanical attrition, by mixing together 92 percent by weight of a styrene n-butylmethacrylate copolymer resin, comprised of 65 percent by weight of styrene, and 35 percent of n-butylmethacrylate, 6 percent by weight of Regal 330 carbon black, and 2 percent by weight of the cetyl pryidinium chloride quaternary salt of the following formula

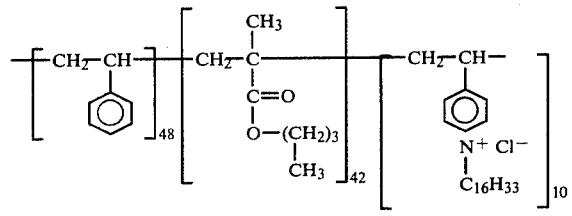

The toner was classified to remove particles below 3 microns, and 3 parts by weight of the resulting toner and 100 parts by weight of a coated atomized hoganese steel carrier, containing a 0.15 percent Kynar 201 polyvinylidene chloride coating, commercially available from Penwalt were mixed together to form the developer composition.

The above developer composition is then utilized to develop images in a xerographic imaging system using a negatively charged photoresponsive device comprised of an aluminum substrate, a generating layer of trigonal selenium and a transport layer of N,N'-diphenyl-N,N'-bis(3-methyl phenyl)-[1,1'-biphenyl]-4,4'-diamine dispersed in a polycarbonate, as disclosed in U.S. Pat. No. 4,265,990. Images of excellent resolution with high solid area density are obtained.

EXAMPLE II

The procedure of Example I is repeated with the exception that there is utilized in place of the cetyl pyridinium chloride quaternary salt indicated a cetyl quaternary ammonium salt of the following formula:

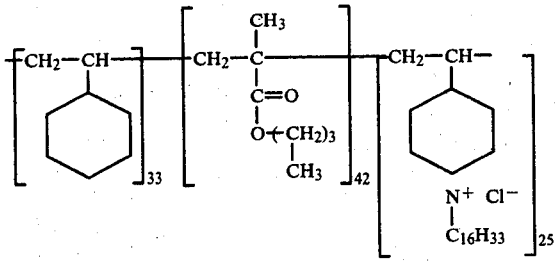

Substantially similar results are obtained when a developer composition containing the above-identified cetyl pyridinium quaternized salt was employed to develop images in an electrostatic latent imaging system using the photoresponsive device of Example I.

EXAMPLE III

The procedure of Example I is repeated with the exception that there is utilized in place of the cetyl pyridinium chloride quaternary salt a cetyl pyridinium chloride quaternary salt of the following formula

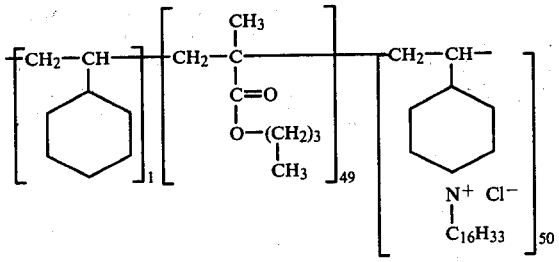

Substantially similar results are obtained when the cetyl pyridinium chloride quaternary salt of this Example is utilized in the imaging device of Example I.

EXAMPLE IV

There is prepared a developer composition in accordance with Example I with the exception that there is utilized instead of a cetyl pyridinium chloride quaternary salt a sulfonate quaternary salt of the following formula:

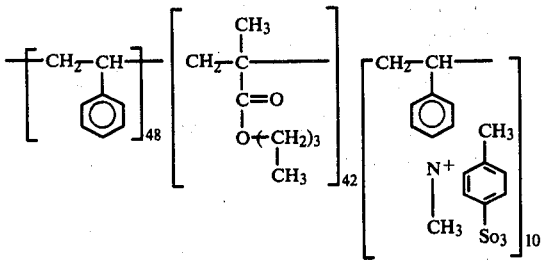

Substantially similar results are obtained when the developer composition of this Example is employed in the imaging system of Example I.

Other modifications of the present invention will occur to those skilled in the art upon a reading of the present disclosure. These are intended to be included within the scope of the present invention. Thus, for example, the corresponding partially quaternized polymers are also included within the scope of the present invention.

We claim:

1. A positively charged dry developer composition comprised of toner resin particles in an amount from about 60 percent by weight to about 80 percent by weight, pigment particles in an amount from about 2 percent by weight to about 20 percent by weight, carrier particles and in an amount of from about 0.1 percent by weight to about 20 percent by weight of a charge enhancing additive selected from the group consisting of those additives of the following formula:

I

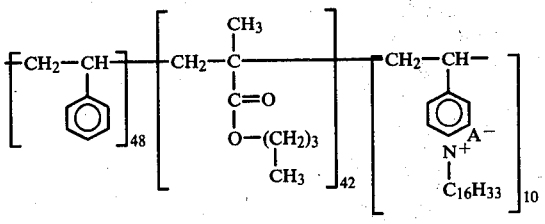

II.

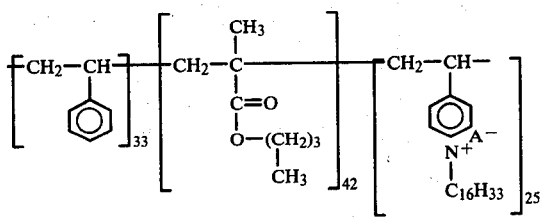

III.

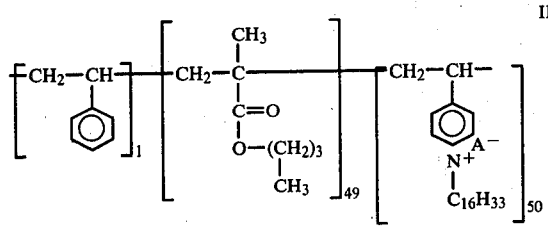

IV.

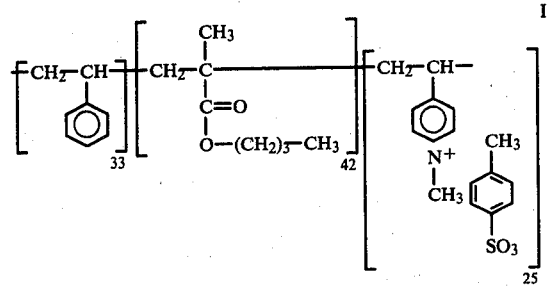

wherein A is the anion chloride, bromide, or methylsulfate.

2. A developer composition in accordance with claim 1, wherein the anion A is chloride.

3. A developer composition in accordance with claim 1, wherein the resin particles are present in an amount of from about 92 percent by weight, and consist essentially of a styrene/n-butylmethacrylate copolymer, the pigment particles are carbon black present in an amount of about 6 percent by weight, the charge enhancing additive is present in an amount of about 2 percent by weight, and the carrier particles consist essentially of a steel core coated with a polyvinylidene chloride resin.

4. A developer composition in accordance with claim 1 wherein the charge enhancing additive is present in an amount of from about 2 percent to about 10 percent by weight.

5. A developer composition in accordance with claim 1 wherein the charge enhancing additive is

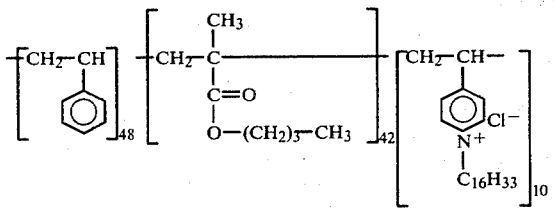

6. A developer composition in accordance with claim 1 wherein the charge enhancing additive is

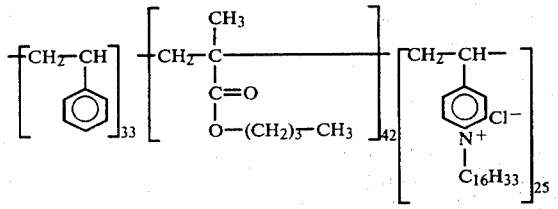

7. A developer composition in accordance with claim 1 wherein the charge enhancing additive is

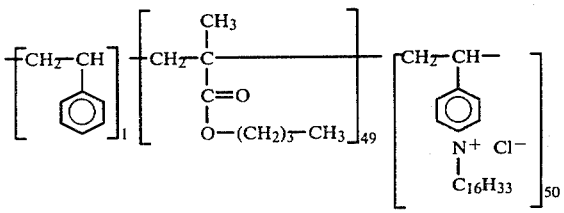

8. A developer composition in accordance with claim 1 wherein the charge enhancing additive is

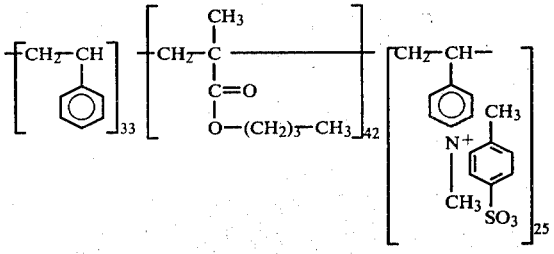

9. A developer composition in accordance with claim 1 wherein the charge enhancing additive is present in an amount of from about 0.1 weight percent to about 20 weight percent, and the pigment is carbon black present in an amount of from about 3 weight percent to about 12 weight percent.

10. A method of imaging comprising forming an electrostatic latent image on an imaging member, contacting the image with a positively charged dry developer composition, comprised of resin particles in an amount of from about 60 percent by weight to about 80 percent by weight, pigment particles in an amount of from about 2 percent by weight to about 20 percent by weight, carrier particles, and in an amount of from about 0.1 percent by weight to about 20 percent by weight of a charge enhancing additive selected from the group consisting of those additives of the following formula:

I.

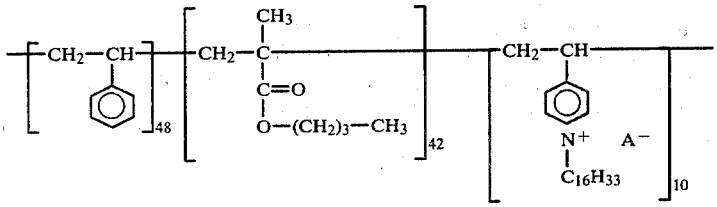

II.

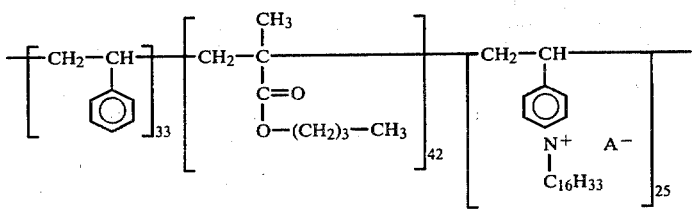

III.

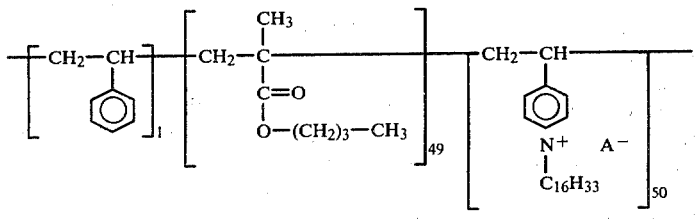

-continued

IV.

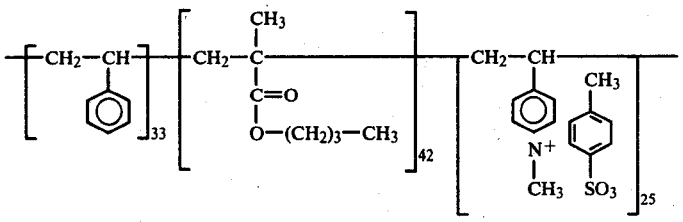

wherein A is the anion chloride, bromide, or methylsulfate.

11. A method of imaging in accordance with claim 10, wherein the anion A is chloride.

12. A method of imaging in accordance with claim 10, wherein the resin particles are present in an amount of about 92 percent by weight, and consist essentially of styrene/n-butyl methacrylate copolymer, the pigment is carbon black present in an amount of about 6 percent by weight, the charge enhancing additive is present in an amount of 2 percent by weight, and the carrier particles consist essentially of steel coated with a polyvinylidene chloride resin.

13. A method of imaging in accordance with claim 10 wherein the charge enhancing additive is of the formula:

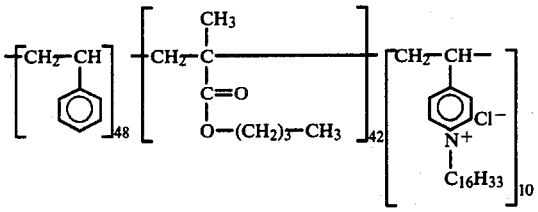

14. A method of imaging in accordance with claim 10 wherein the charge enhancing additive is of the formula

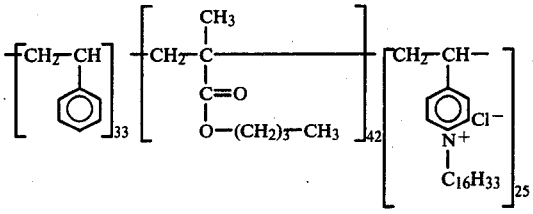

15. A method of imaging in accordance with claim 10 wherein the charge enhancing additive is of the formula;

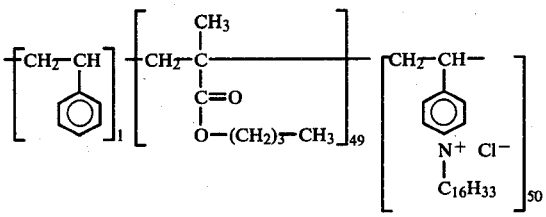

16. A method of imaging in accordance with claim 10 wherein the charge enhancing additive is present in an amount of from about 0.1 weight percent to about 20 weight percent, and the pigment particles are present in an amount of from about 3 percent to about 12 percent by weight.

* * * * *